United States Patent [19]

Tsubata

[11] 4,231,139

[45] Nov. 4, 1980

[54] WOVEN STRINGER FOR SLIDE FASTENERS

[75] Inventor: Noritaka Tsubata, Uozu, Japan

[73] Assignee: Yoshida Kogyo K.K., Tokyo, Japan

[21] Appl. No.: 49,474

[22] Filed: Jun. 18, 1979

[30] Foreign Application Priority Data

Jul. 3, 1978 [JP] Japan ..... 53-80767

[51] Int. Cl.[3] ..... A44B 19/00

[52] U.S. Cl. ..... 24/205.16 R; 57/235; 139/384 R; 428/253; 428/257

[58] Field of Search ..... 139/384 B, 384 R; 24/205.16 R; 428/225, 192, 253, 257; 57/235

[56] References Cited

U.S. PATENT DOCUMENTS

| | | | |
|---|---|---|---|
| 3,143,779 | 8/1964 | Hendley | 24/205.16 R |
| 3,454,052 | 7/1969 | Burbank | 139/384 R |

*Primary Examiner*—James J. Bell

*Attorney, Agent, or Firm*—Bucknam and Archer

[57] ABSTRACT

A slide fastener stringer is disclosed which has a fastener element in the form of a helical coil having a row of successive loops woven into a longitudinal edge of a stringer tape simultaneously as the tape is woven. The fastener element is held stably in position by a stuffing cord which is anchored therein by weave threads. A guide cord is arranged such that it may be deformed under tension applied by a binding thread to provide slider guide surfaces.

5 Claims, 8 Drawing Figures

WOVEN STRINGER FOR SLIDE FASTENERS

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a row of successive elongated loops or convolutions each having a coupling head, an upper and a lower leg and a connecting portion.

Most of the known fasteners, however, have failed to meet with the requirements for the success of the so-called woven slide fasteners which largely depends on one hand, upon the positional stability of the filament, i.e. coupling fastener element, with respect to the stringer tape against external stresses, and on the other hand, upon smooth coupling and uncoupling of the opposed stringer by the action of a reciprocating slider.

A woven slide fastener was proposed in Japanese Patent Application No. 53-91 wherein a stuffing cord is inserted longitudinally through the coil of the filament and a guide cord or cords is disposed longitudinally of the filament in contact with the connecting heel portions of the coupling filament loops, the stuffing and guide cords being bound integrally with the coupling filament by the weave threads of the tape.

SUMMARY OF THE INVENTION

The present invention is directed to improvements in and relating to the above prior-art woven slide fastener, and has for its primary object to provide means of stabilizing the fastener filamentary element on the stringer tape, and for another object to provide means of facilitating smooth operative movement of the slider along the fastener stringer.

According to the invention, there is provided a woven fastener stringer comprising a woven tape formed with foundation warp and weft threads and consisting of a web section defining a major dimension of said tape and a woven filament section defining a longitudinal edge portion of said tape; a row of successivley interconnected elongated loops woven into said filament section and interengageable with another row on a mating stringer by the action of a slider, each of said loops having a coupling head at one end thereof, an upper leg and a lower leg extending from said head in a common direction, and a heel portion remote from said head connected to a next adjacent one of said successive loops; a plurality of covering warp threads overlying and underlying said loops; a stuffing cord extending longitudinally of the tape through said row of loops; a guide cord extending longitudinally of the tape in abutting engagement with the other surfaces of said heel portions; and a binding weft thread continuing from said foundation and interwoven with said covering warp threads in said woven filament section, said binding weft thread being tensioned to bite into the material of said stuffing cord and deform said guide cord to produce a rigid guide surface for the slider.

These and other objects and features of the invention will appear clear form the following detailed description of the invention taken in connection with the accompanying drawings which illustrate by way of example a preferred embodiment.

BRIEF DESCRIPTION OF THE DRAWINGS

In the drawings, like reference numerals or characters refer to like parts throughout the several views.

DETAILED DESCRIPTION OF THE PREFERRED EMBODIMENT

Figure 1:
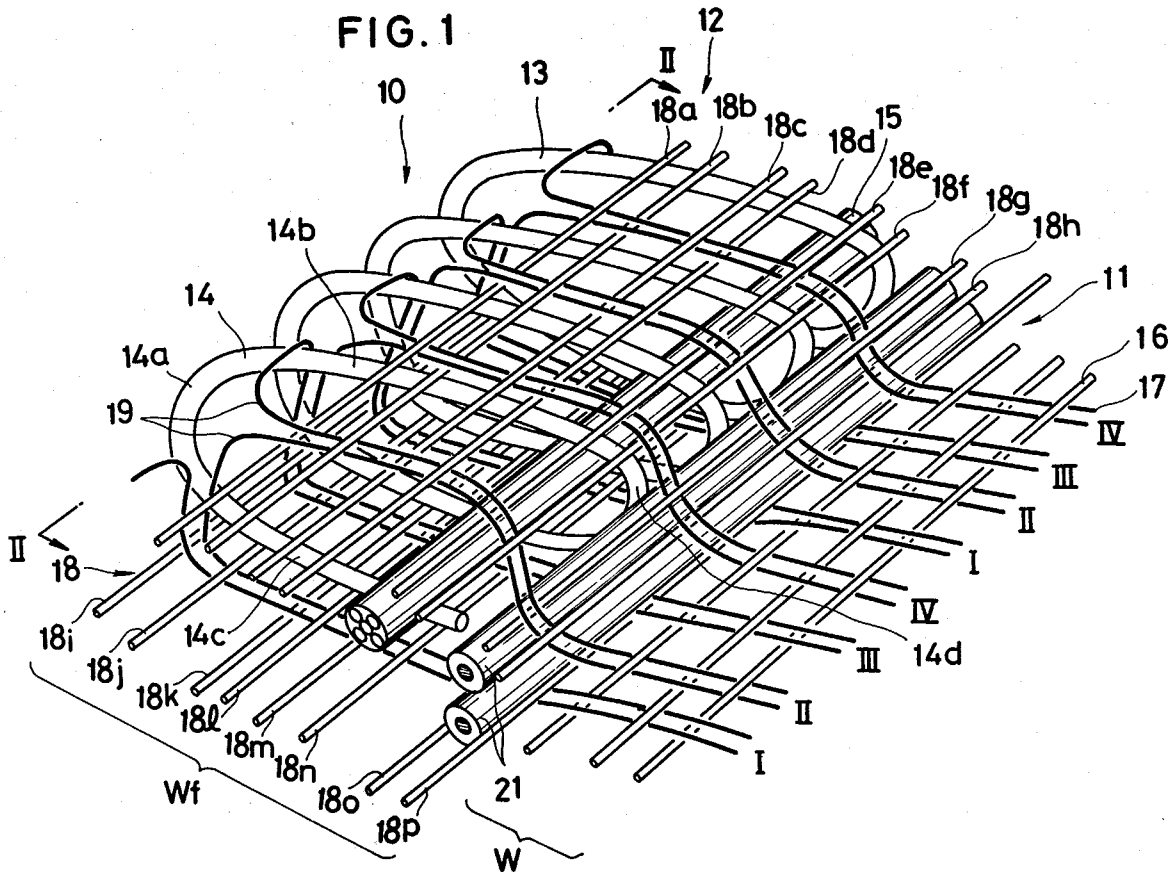
FIG. 1 is an enlarged fragmentary perspective view of a woven fastener stringer according to the invention.

Referring now to FIG. 1, there is shown a fastener stringer generally designated 10 which constitutes one part of a pair of two identical stringers for a slide fastener. The stringer 10 consists of a generally flat web section W defining a major dimension of a woven tape 11 and a woven filament section Wf defining a longitudinal edge portion or beaded edge 12 into which a filament 13 of plastic material is woven. The filament 13 is formed from a linear blank of a suitable plastic material into a helically coiled structure having a succession of loops or elongated convolutions 14 during weaving of the tape 11.

Figure 2:
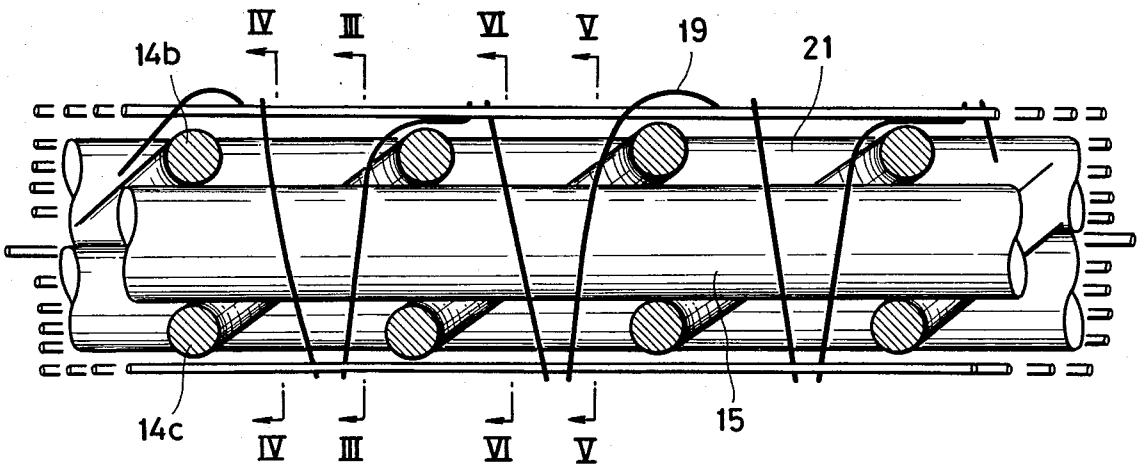
FIG. 2 is a longitudinal cross-sectional view taken on the line II—II of FIG. 1.

Each loop or elongated convolution 14 in the filament 13 has a coupling head **14*a* at one end thereof, an upper leg 14*b* and a lower leg 14*c* extending from the head 14*a* in a common direction and a heel portion 14*d* remote from the head 14*a* connected to a next adjacnet one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 2 and define therebetween a longitudinally extending "tunnel" or hollow conduit through which a stuffing cord 15** is inserted in a manner hereafter to be described.

The web section W of the tape 11 may be of any known design having foundation warp threads 16 and foundation weft thread 17 which may be interwoven in a variety of known patterns.

The term "filament woven section Wf" is used to define a longitudinal edge portion of the tape 11 into which the filament 13 serving as a coupling element for a slide fastener is woven.

The row of coupling loops 14 is secured to the tape 11 at the filament woven section Wf by a plurality of covering warp threads 18, which extend in parallel with the foundation warp threads 16, and a binding weft thread 19 which is a continuous portion of the foundation weft thread 17.

There are provided for purposes of illustration a total of sixteen covering warp threads 18, the first eight ones designated 18*a* through 18*h* being disposed to overlie the upper leg portions 14*b* and the second eight ones 18*i*–18*p* to underlie the lower leg portions 14*c* of the coupling filament loops 14.

Figure 3:
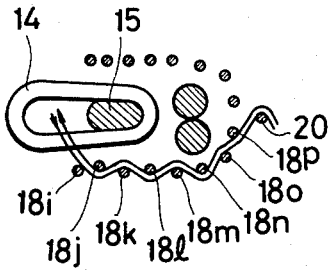
FIG. 3 is a sectional view taken on the line III—III of FIG. 2.
Figure 4:
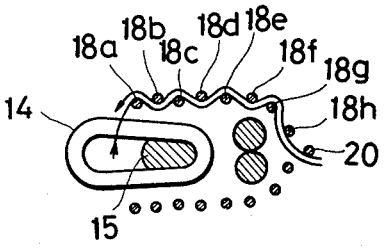
FIG. 4 is a sectional view taken on the line IV—IV of FIG. 2.
Figure 5:
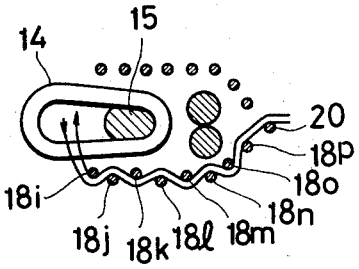
FIG. 5 is a sectional view taken on the line V—V of FIG. 2.
Figure 6:
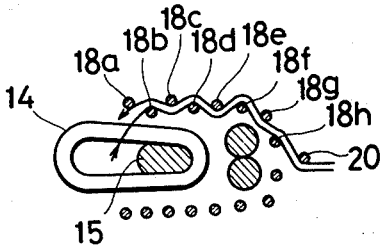
FIG. 6 is a sectional view taken on the line VI—VI of FIG. 2.

The binding weft thread 19, which is interwoven in a double pick with the covering threads 18, passes through the web section W into each pitch of adjacent loops 14. The first double pick I of the weft 19, as better shown in FIG. 3, passes over a terminal foundation warp thread 20, then in under the covering warp thread 18*p*, alternately over one and under one of the covering warp threads 18–18*o*, further over and around the stuffing cord 15, back to the web section W. The second double pick II, as shown in FIG. 4, passes under the terminal warp thread 20, then in under the covering warp thread 18*h*, alternately over one and under one of the warp threads 18*g*–18*a*, again over and around the cord 15, back to the web section W. The third double pick III, as shown in FIG. 5, passes over the terminal warp thread 20, over the covering warp thread 18*p*, then alternately under one and over one of the warp threads 18*o*–18*i*, again over and around the cord 15, back to the web section W. The fourth and last double pick IV to complete one weaving cycle passes under the terminal warp thread 20, then over the covering warp thread 18*h*, alternately under and over the warp threads 18*g*–18*a*, again over and around the cord 15, back to the web section W, as shown in FIG. 6.

On its return travel, the binding weft thread 19 pulls the stuffing cord 15 toward the heel portions 14*d* of the coupling loops 14, the cord 15 thereby being anchored in between the upper and lower legs 14*b* and 14*c* against the inner peripheral surfaces of the heel portions 14*d*.

Designated at 21 is a guide cord extending longitudinally of the tape 11 behind the heel portions 14*d* of successive loops 14. The guide cord 21, two of which are preferrably used in superposed relation as in the case illustrated, is bound in place against the external peripheral surfaces of the heel portions 14*d* by the covering warp threads 18 and the double pick of the binding weft thread 19 as shown.

It has now been found that the use of a twisted yarn for the stuffing cord 15 provides increased positional stability of the individual coupling loops 14 of the filament on account of the fact that when the stringer 10 is dyed or otherwise thermally treated the twists in the cord 15 tend to get slackened or radially swollen thereby urging the binding weft thread 19 toward the coupling heads 14*a* of the loops 14; that is, with the binding weft thread 19 biting into the material of the cord 15 and thus securing the coupling filament loops 14 firmly in place against slippage or displacement. This effect may be further enhanced by constructing the stuffing cord 15 with short cotton fibers which are twisted around a filament core such that the resulting cord may be more easily swollen or expanded when treated with heat and water as in the process of finishing a slide fastener.

Figure 7:
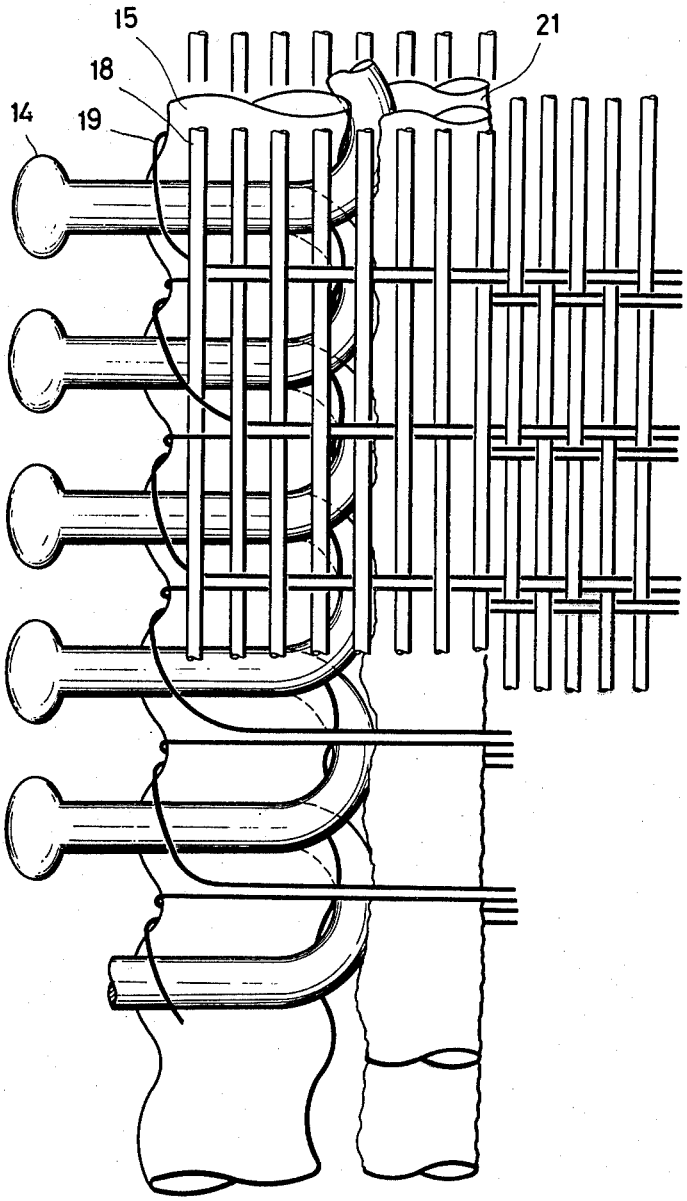
FIG. 7 is an enlarged plan view of a woven fastener stringer according to the invention.
Figure 8:
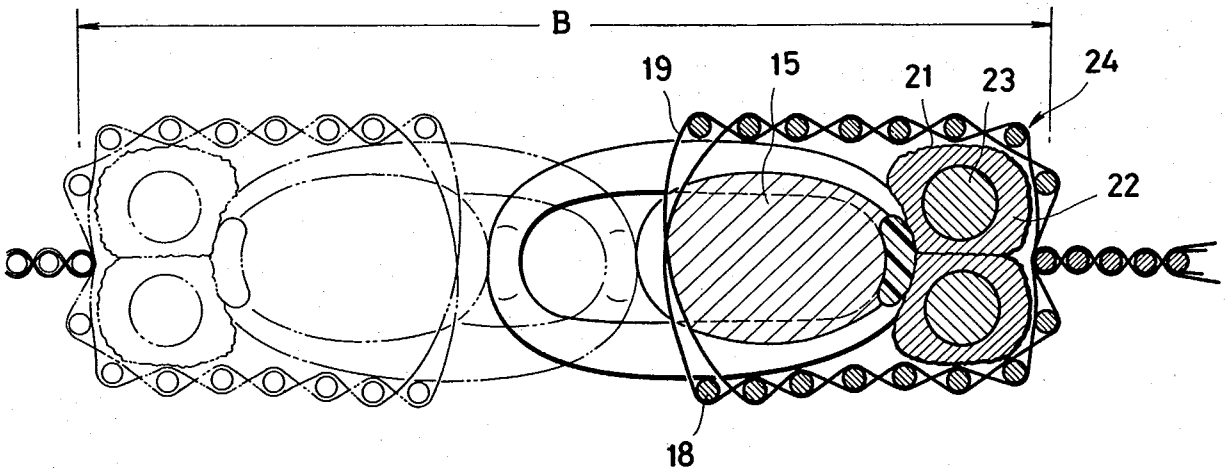
FIG. 8 is an enlarged transverse cross-sectional view of two companion stringers which have been coupled together.

It has also been found that by constructing the guide cords 21 with a knit structure 22 wound around a core 23, satisfactory results can be obtained in that the knit structure 22 is deformed as shown in FIGS. 7 and 8, under the influence of tension applied by the binding weft thread 19 to conform with the outer peripheral surfaces of the heel or connecting portions 14*d* of the successive loops 14 and hence becomes stiff and rigid as a whole with an outer peripheral edge 24 configured to fit with the interior guide wall of a slider (not shown), thus providing for better guidability of the slider. The core 23 may be made of a plurality of yarns either twisted or untwisted.

Another advantage of the knitted guide cords 21 is that their total dimensions remain substantially unchanged while the stuffing cord 15 becomes radially expanded when the stringer 10 is thermally treated, so that the total breadth B of the two companion stringers remains also substantially unchanged. The extent to which the cord 15 expands radially or transversely of the tape 11 is taken up equivalently by the tension on the binding weft thread 19 which produces firm unification of the coupling loops 14, stuffing cords 15 and binding weave threads 18,19.

Although various minor modifications may be suggested by those versed in the art, it should be understood that I wish to embody within the scope of the patent warranted hereon, all such embodiments as reasonalby and properly come within the scope of my contribution to the art.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section and interengageable with another row on a mating stringer by the action of a slider, each of said loops having a coupling head at one end thereof, an upper leg and a lower leg extending from said head in a common direction, and a heel portion remote from said head connected to a next adjacent one of said successive loops; a plurality of covering warp threads overlying and underlying said loops; a stuffing cord extending longitudinally of the tape through said row of loops; at least one guide cord having a knit structure wound around a core and extending longitudinally of the tape in abutting conforming engagement with the outer peripheral surfaces of said heel portions; and a binding weft thread continuing from said foundation and interwoven with said covering warp threads in said woven filament section, said binding weft thread being tensioned to bite into the material of said stuffing cord and deform said guide cord to produce a rigid guide surface for the slider, said stuffing cord being thermally expandable to augment the effective bite of said binding weft thread into the material of the stuffing cord.

2. A woven fastener stringer as defined in claim 1 wherein said stuffing cord is made of twisted yarns.

3. A woven fastener stringer as defined in claim 1 wherein said stuffing cord is formed by short cotton fibers wound around a filament core.

4. A woven fastener stringer as defined in claim 1 wherein said guide cord is made of a knitted fabric wound around a yarn core.

5. A woven fastener stringer as defined in claim 1 wherein two of said guide cords are superposed one upon the other.

* * * * *